United States Patent [19]

Durant

[11] Patent Number: 4,664,162

[45] Date of Patent: May 12, 1987

[54] VALVE BAG PLACER

[75] Inventor: Will G. Durant, Tustin, Calif.

[73] Assignee: Westmont, Inc., Placentia, Calif.

[21] Appl. No.: 824,801

[22] Filed: Jan. 31, 1986

Related U.S. Application Data

[63] Continuation of Ser. No. 661,900, Oct. 17, 1984, abandoned.

[51] Int. Cl.[4] ..... B65B 43/18

[52] U.S. Cl. ..... 141/154; 53/573; 141/10

[58] Field of Search ..... 53/386, 573; 141/10, 141/68, 114, 154, 166, 315; 198/689, 736; 271/3.1, 157

[56] References Cited

U.S. PATENT DOCUMENTS

| | | | |
|---|---|---|---|
| 3,312,038 | 4/1967 | Knauf | 53/573 |
| 3,706,179 | 12/1972 | Tanaka et al. | 53/386 X |
| 3,715,858 | 2/1973 | Durant et al. | 53/573 |
| 4,334,558 | 6/1982 | Durant | 141/114 |
| 4,411,296 | 10/1983 | Durant | 141/68 X |

*Primary Examiner*—Stephen Marcus
*Assistant Examiner*—Mark Thronson
*Attorney, Agent, or Firm*—Leonard Tachner

[57] ABSTRACT

A bag placer apparatus having a number of improvements which, in combination, significantly increase the rate of placing valve bags upon a plurality of filling spouts to fill the bags with a flowable material. The apparatus comprises a pair of magazine apparatus for stacking the bags, a transfer apparatus for removing one bag at a time from the stack, a presenter apparatus for aligning the bag with the valve portion thereof in a precise location, and a picker-spouter apparatus which picks up the aligned bag, opens the valve and places it upon any one of one, two or three filling spouts. Each magazine supports a plurality of vertical stacks of horizontally positioned bags. The transfer apparatus alternatively de-stacks one bag at a time from each magazine and transfers it laterally to the presenter apparatus. The presenter apparatus includes means including a novel tilt arm for automatically transfering and registering each bag in precise position and alignment relative to the picker-spouter apparatus. The picker-spouter apparatus includes means for greater reliability in opening the valve of a bag and placing it securely on each filling spout. A novel two-step swing operation enables simultaneous swing and shuttle motion of the picker-spouter apparatus to increase bag placing speed.

8 Claims, 8 Drawing Figures

VALVE BAG PLACER

This is a continuation of application Ser. No. 661,900 filed Oct. 17, 1984, now abandoned.

BACKGROUND OF THE INVENTION

1. Field of the Invention

The present invention relates to apparatus for automatically placing valve bags onto a filler spout to be filled thereby. More specifically, the present invention relates to an automatic apparatus for placing valve equipped bags upon the spouts of up to three filling machines through which the bags may be filled with flowable particulate material.

Valve bags are of the type which comprise a top which is open at one end so as to be able to receive the filling spout of a filling machine. The principal advantage of such bags is that they close automatically when filled and removed from the machine so that no sealing procedures are needed to close the bags at their top subsequent to their being filled.

2. Prior Art

The prior art most relevant to the present application is U.S. Pat. No. 4,334,558 to Durant, the applicant of the present invention. A substantial number of additional prior art patents, although less relevant are also pertinent and are disclosed in the aforementioned U.S. Pat. No. 4,334,558.

As noted in the aformentioned patent of the present applicant, the valve bag placer disclosed therein overcomes a number of substantial disadvantages of the prior art. By way of example, the aforementioned bag placer disclosed by the present applicant is capable of satisfactorily handling valve bags of the type made of lightweight plastic. Furthermore, the prior invention of the applicant significantly reduces the amount of time and labor required in stacking the bags to be placed on a spout of a filling device by substantially reducing the exent to which care and accuracy must be employed in aligning bags in stacks to be automatically placed on the spout. Still a further feature of the aforementioned invention of the applicant is a substantial increase in reliability of the mechanism used for opening the valve end of the bag to insure positive placement of the open valve portion on the filler spout and thereby prevent particulate material from being poured onto the ground or otherwise poured outside of the bag.

Despite the significant advantages provided by the invention of applicant disclosed in the aforementioned U.S. Pat. No. 4,334,558, over the years of operation of the bag placer disclosed therein, a number of significant additional improvements have been developed. The principal benefit provided by these improvements relates to the speed and reliability of the apparatus and therefore to the number of bags that can be placed per unit time using the present invention. It is to these speed-related, significantly advantageous improvements that the present application is primarily directed. The disclosure of U.S. Pat. No. 4,334,558 is incorporated herein by reference.

SUMMARY OF THE INVENTION

Like the aforementioned prior invention of the applicant, the present invention utilizes a unique combination of apparatus to provide an automatic valve bag placer system that eliminates or substantially reduces the disadvantages of the prior art described in the aforementioned earlier issued patent. Thus the invention also utilizes a combination of a pair of magazine apparatus each having a plurality of horizontal platforms; a transfer apparatus that alternately transfers one bag at a time from each magazine to a position above an indexing table of a presenter apparatus and drops the bag onto that table. At the presenter apparatus the bag's registration is automatically adjusted to be appropriate for a fourth apparatus; namely, a picker-spouter which picks up the bag, opens the valve and places the bag valve on any of up to three filler spouts. However because of a significant number of additional improvements specifically described and claimed hereinafter, the present invention achieves the aforementioned advantages of applicant's earlier invention with a significantly increased rate of bag placing, namely a bag placing rate that is at least two times that of the previously described apparatus. Thus for example in the present invention, two of the aforementioned magazines are utilized to at least double the rate at which bags are delivered to the indexing table. In addition, the indexing table has been improved in a number of ways. For example in applicant's prior invention, when the bag was dropped on the indexing table, the indexing table was in a substantially horizontal position. It was then tilted at a selected angle to allow the bags to slide into position where its edges would be indexed prior to removal of the bag from the indexing table by the picker-spouter apparatus. thus the prior invention utilized only gravity to place the bag in a suitable position for retrieval by the picker-spouter apparatus and eventual placement onto the spout of the filler apparatus. Furthermore, the tilt table was occupied until the bag was picked up. In the present invention the presenter apparatus comprises an indexing table which is always stationary but which includes means for forceably placing the bag in proper position for the picker-spouter apparatus thereby significantly increasing the speed at which valve bags are presented to the picker-spouter apparatus for placement on a filler spout. A novel tilt arm forceably moves the bag and then immediately returns to its nominal position for movement of the next bag into proper registration.

Another significant improvement in the present invention resides in the design of the picker-spouter apparatus and the motion of the bag produced therewith. More specifically, as a result of the change in the configuration of the indexing table of the present invention, it has been possible to redesign the picker-spouter apparatus so that the linear motion of the bag as it is being picked up from the indexing table is substantially reduced, thereby significantly reducing the time required to place the bag on each spout of filler apparatus. In addition, because of the significant increase in the rate of bag placing achieved by the improvements of the present invention, it is possible by means of the present invention to utilize as many as three separate filler spouts simultaneously. Consequently, the pick-spouter apparatus of the present invention has been further improved by being provided with the capability of moving transversely between multiple filler spouts symmetrically displaced from the indexing table. The present invention thus achieves the novel and highly advantageous result of placing alternate bags on separate filler spouts on demand whereby to significantly enhance the number of bags that can be filled by means of the present invention. Furthermore, it will be seen hereinafter that the manner in which the picker-spouter apparatus of the invention actually picks up the valve end of the bag for placement on the spouter, has been significantly improved to increase the reliability thereof and thus even further enhance the reliability of the placing operation of the present invention despite the increase in the number of bags being handled per unit time.

OBJECTS

It is therefore a primary object of the present invention to provide an improved apparatus for placing valve bags on the filling spouts of up to three filling machines, which apparatus provides substantial improvements specifically directed towards the speed of bag handling as compared to the prior art.

It is a further object of the present invention to provide an improved automatic valve bag placing apparatus which is capable of handling plastic valve bags or valve bags of other material of highly flexible structure at an increased speed but without a reduction in reliability.

It is still a further object of the present invention to provide an improved valve bag placing system including the picker-spouter apparatus which is closer to the bags and which has substantially more reliable means for positively opening the valve mechanism of the bag and for placing the valve bag on any of up to three spouts of a respective number of filling machines.

It is still a further object of the present invention to provide an automatic valve bag placer that utilizes at least two magazine apparatus for receiving vertical stacks of horizontally placed bags, each such bag being positioned on a shelf affixed to a conveyor apparatus and further including transfer means for delivering one bag for each such magazine in alternating sequence to an indexing table which is adapted to present each such bag in substantially identical registered position to a picker-spouter apparatus for placement on a spout.

BRIEF DESCRIPTION OF THE DRAWINGS

The above-indicated advantages and objects of the present invention, as well as additional advantages and objects thereof, will be more fully understood hereinafter as a result of a detailed description of the invention when taken in conjunction with the accompanying drawings in which.

DETAILED DESCRIPTION OF A PREFERRED EMBODIMENT

Figure 1:
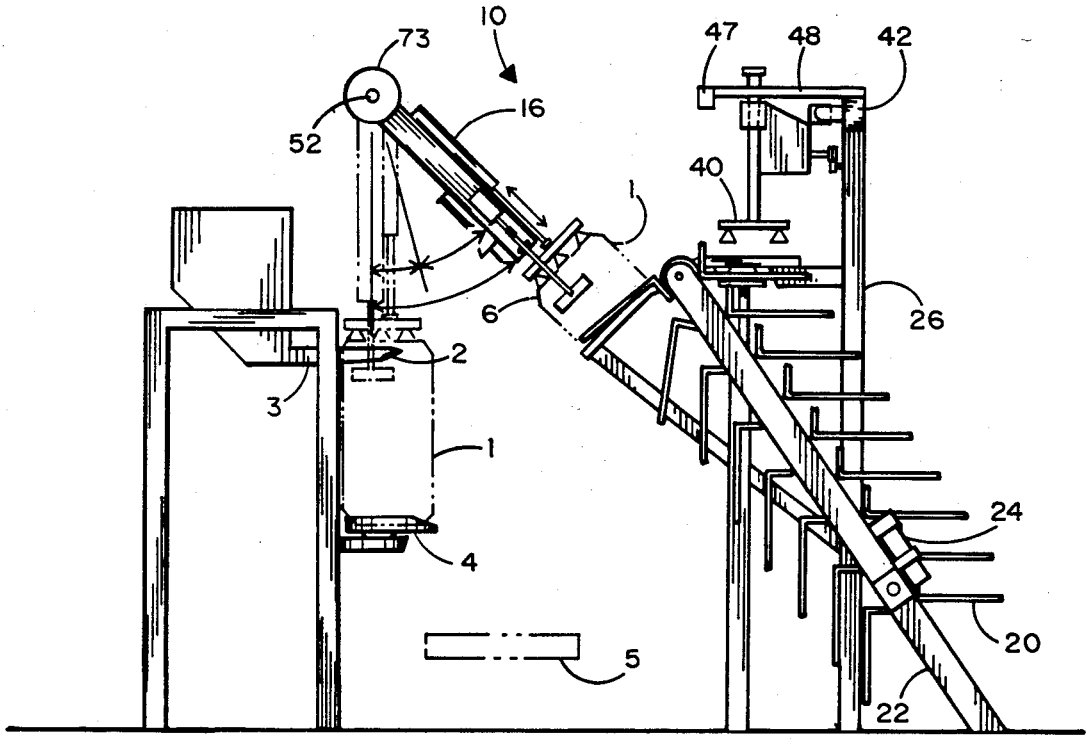
FIG. 1 is a front view of a preferred embodiment of the invention.
Figure 2:
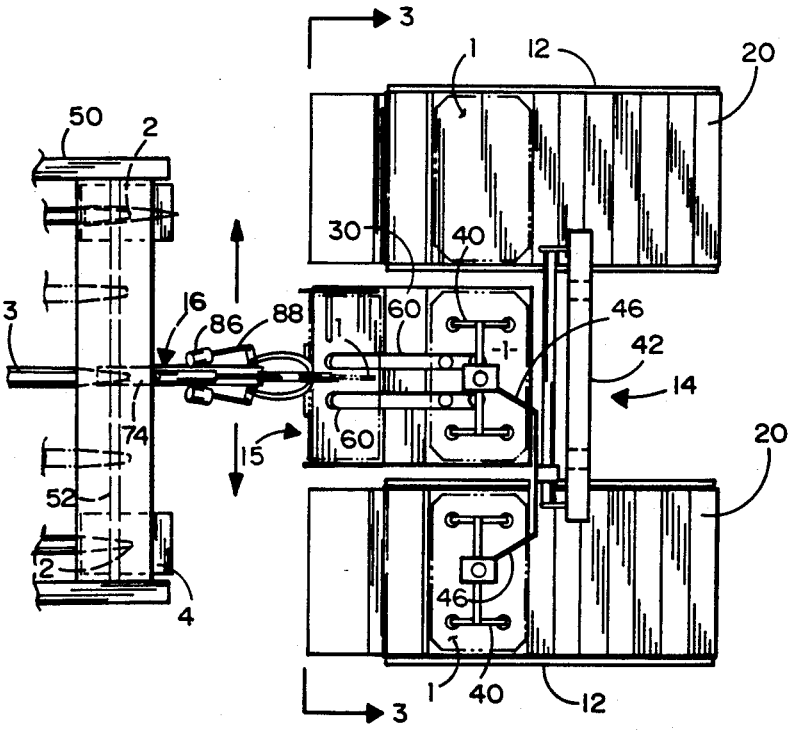
FIG. 2 is a top view of the invention and in conjunction with FIG. 1, illustrates the general flow of bag handling steps involved.

The general features of the present invention and the manner in which valve bags are manipulated by transfer from one such apparatus to another may be readily understood by reference to FIGS. 1 and 2.

As shown in FIG. 1, the bag placer of the present invention automatically places a valve bag 1 on any of up to three packer-filling spouts 2 so that the bag may be filled thereby with a flowable material such as particulate, solid or liquid. Spouts 2 are each affixed to separate fill structures 3 connected to a filling mechanism, not shown, which is adapted to transfer the flowable material to the bag from a source of such material also not shown.

Because of the automatic nature of the invention it will be understood that it is desirable to also automate the filling process after the bag has been placed on the spout while preventing any spillage or partial filling of the bag which would detract from the benefits provided by the present invention. Accordingly, it is tyical to use the present invention with a filling mechanism that also includes a sensing device in proximity to each spout 2 for the purpose of starting the flow of the particulate solid or other such flowable material only after a valve bag 1 has been placed securely on the corresponding spout. FIG. 2 illustrates a total of five filling spouts 2. Actually, only the middle spout and uppermost and lowermost spouts would be used for filling three bags. The remaining two spouts represent spout positions if only two bags are to be filled simultaneously.

Also shown in FIG. 1 is a scale 4 attached to each fill structure 3 for the purpose of weighing each of the bags as it is being filled so that the flow of material into the bags can be terminated when a precise weight of material has been injected into the bag. When the scale registers a precise weight depending upon the density of the material and the volume of the bag, a device for ejecting the filled bag onto a conveyor belt 5, but not shown in the drawing, would automatically commence operation, freeing each spout 2 for the next empty bag to be placed thereon by the present invention.

It will be understood that the valve bags, the means for filling the bags for sensing the appropriate weight of the contents thereof and for ejecting and conveying the filled bag from the filling structure, may be conventional in nature but in any case do not constitute features of the present invention.

The improved bag placer 10 of the present invention includes five principal apparatus namely, a pair of magazine apparatus 12, transfer apparatus 14, presenter apparatus 15 and picker-spouter apparatus 16. It will be understood that in the accompanying figures a valve bag 1 is shown in a variety of configurations during the sequence of operation whereby each valve bag is eventually placed upon one of up to three spouts 2.

Each such valve bag comprises a valve end for being placed on a filling spout. The valve end of each bag provides an orifice and an openable portion which is adjacent the orifice and can be extended to gain access to the orifice.

As seen best in FIGS. 1 and 2 the aforementioned apparatus of the present invention are arranged so that there is one magazine apparatus 12 on either side of and substantially adjacent to the transfer apparatus 14 and presenter apparatus 15. The two magazine apparatus 12, the transfer apparatus 14 and presenter apparatus 15 are located in spaced and opposed relation to a symmetrically positioned picker-spouter apparatus 16 which is in turn symmetrically positioned relative to one, two or three filling spouts 2. One novel feature of the invention is a picker-spouter apparatus that is configured for travel between as many as three filling spouts whereby valve bags 1 are alternately removed from the respective stacks of bags on the magazine apparatus 12 and placed alternately on any one of the respective spouts 2 for filling. Unlike the apparatus disclosed in the aforementioned prior issued patent of the applicant herein, the picker-spouter apparatus of the present invention is configured to travel transversely as well along a travel rod 52 thereby rendering it possible to place valve bags on as many as three filling spouts.

Each magazine apparatus 12 may be considered the first apparatus of the combination comprising the present invention because it is the means for receiving vertical stacks of horizontally placed bags, each such bag being positioned on a shelf 20. There are a plurality of such tiered shelves rotatably affixed to a shelf conveyor apparatus 22. A gear motor 24 provides the force needed to effect movement of the shelf conveyor apparatus 22 as indicated by the arrowheads in the right-most portion of FIG. 1. Such movement is utilized intermittently to position a stack of valve bags and into proper registration with the remaining portions of the invention. One bag at a time is removed from each such stack while each magazine apparatus 12 remains stationary. Ultimately, when the last bag on the upper-most horizontal shelf 20 is removed for placement by the invention on a spout 2, a photoelectric sensing device 47 positioned by sensor arm 48 vertically elevated from and in alignment with the upper-most shelf from which the bags are being removed, senses that the last such bag has been removed. This causes motor 24 to be activated whereby shelf conveyor apparatus 22 positions the next horizontal shelf into proper alignment with the remaining portions of the invention. Simultaneously, the newly emptied shelf is positioned out of the way so that it does not obstruct the continuing bag placement process. As shown in FIG. 1, the emptied shelves are eventually rotated to the underside of shelf conveyor apparatus 22 into a freely hanging vertical position where the sequence of operation of each magazine apparatus 12 eventually repositions the emptied shelves into horizontal configurations to receive additional stacks of empty valve bags.

As will be seen hereinafter, although the improvements provided in the present invention render it possible to significantly increase the rate of bag handling and thus make it necessary to utilize two magazine apparatus 12, each such apparatus 12 remains essentially identical to the magazine apparatus disclosed in applicant's prior patent, U.S. Pat. No. 4,334,558. The first apparatus to be discussed which comprises a significant and novel departure from the corresponding apparatus of applicant's prior invention is the transfer apparatus 14 which alternately shuttles one bag from each magazine apparatus 12 to the presenter apparatus 15.

Presenter apparatus 15 may be best understood by reference to FIGS. 1–5. As seen in FIGS. 1–5, apparatus 15 comprises a support structure 26 having a transverse shuttle assembly 42 integral thereto. Shuttle assembly 42 comprises a rodless cylinder 45 to which a carriage plate 44 is affixed for transverse movement. A pair of "H" frame suction cup assemblies 40 is affixed to the carriage plate 44, one such assembly 40 being affixed to each end of the carriage plate by means of an angle bracket 46. The two suction cup assemblies are thus spaced apart a fixed distance equal to the distance between the center of a magazine shelf 20 and the center of indexing table 30 (to be discussed hereinafter). Each suction cup assembly 40 is also positioned in spaced relation to carriage plate 44 to be in an appropriate position to symmetrically lift each bag 1 from the uppermost shelf 20 of the respective magazine apparatus 12 for transfer to the presenter apparatus 15.

Figure 3:
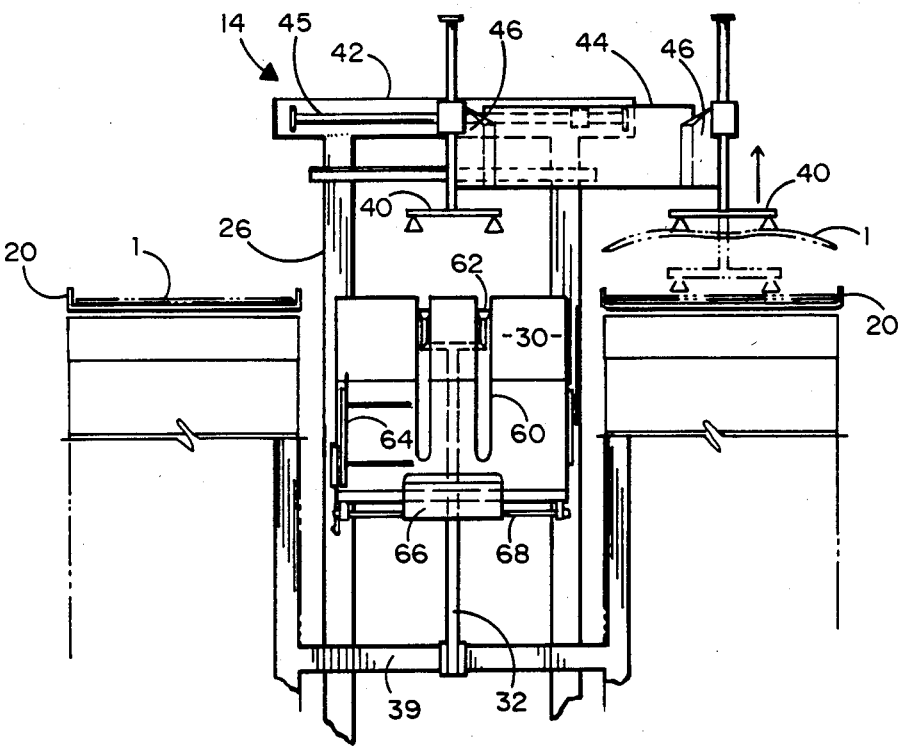
FIGS. 3, 4 and 5 are sequenced elevation views of the transfer and indexing apparatus of the present invention illustrating the manner in which valve bags are handled by that portion of the novel combination herein disclosed.
Figure 4:
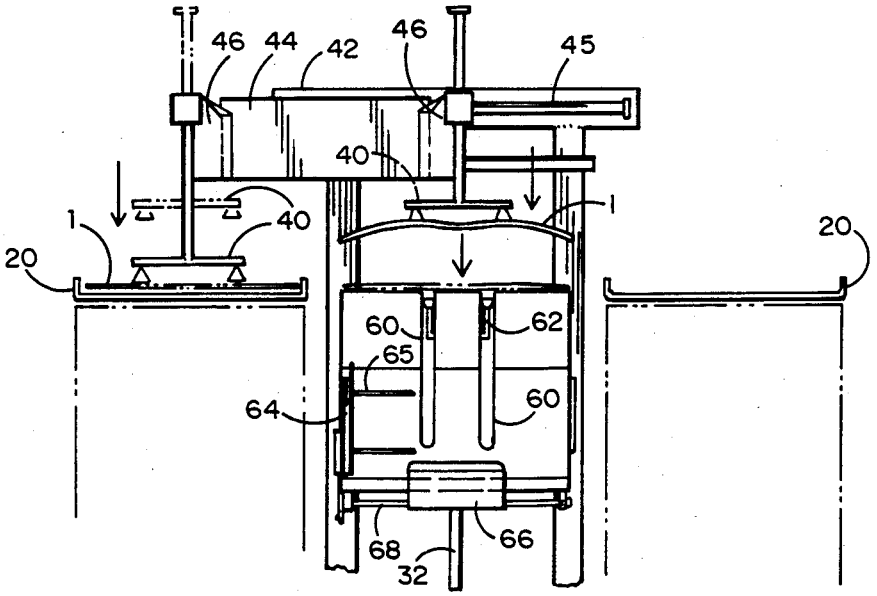

There is one such suction cup assembly for each magazine apparatus. The transverse shuttle assembly 42 permits movement of the suction cup assemblies in a coordinated manner whereby one such assembly moves between the center of presenter apparatus 15 to its right extreme location and the other moves from the center of the presenter apparatus to the left extreme location in a manner illustrated in FIGS. 3, 4 and 5. Thus for example, assuming initial start-up conditions, it is seen in FIG. 3 that the right-most suction cup assembly 40 has just been extended to pick up a bag 1 from magazine apparatus 12 on the right side of the figure and then retracted to lift the bag up above the magazine assembly in position for transfer towards indexing table 30. As seen in FIG. 4 when the right-most transfer mechanism has brought the right-most suction cup assembly to the center of the presenter apparatus 15, the suction cup assembly vacuum is released and the bag is dropped onto a horizontal surface or drop plate 33 of the indexing plate 30. Substantially concurrently therewith, the left-most suction cup assembly 40 is transferred to the left position magazine apparatus and more specifically, over the upper-most shelf 20 for lifting a bag therefrom in the same manner described for the right-most magazine apparatus.

Figure 6:
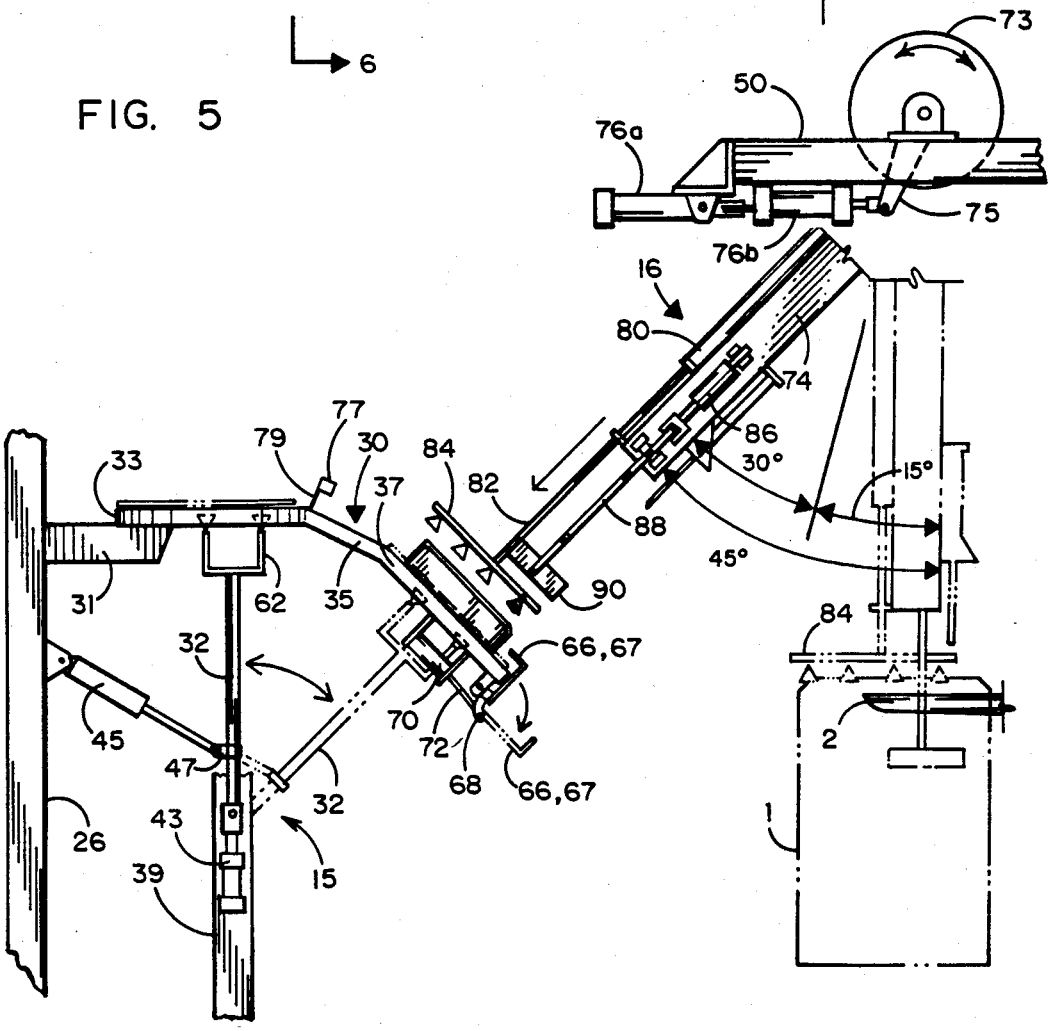
FIG. 6 is a more enlarged detailed front view of the transfer and indexing apparatus and of the picker-spouter apparatus of the invention.

Presenter apparatus 15 includes an indexing table or plate 30 affixed by a pair of parallel legs 31 to support structure 26 as seen best in FIG. 6.

As seen best in FIG. 6, indexing table or plate 30 comprises three integral planar surfaces, 33, 35 and 37. Drop plate 33 is substantially horizontal and is adapted to receive valve bags transferred from the respective magazine apparatus 12 on either side of the presenter apparatus 14. Presenter plate 37 is canted at 45 degrees relative to the horizontal drop plate 33 and, as will be seen hereinafter, is adapted to provide means for registering the edges of each valve bag whereby to place the bag in the proper position for the picker-spouter apparatus 16 as will be hereinafter more fully described. A third surface 35 of indexing table or plate 30 interconnects horizontal surface 33 and 45 degree canted surface 37 and is integral thereto and provides an intermediate angular relationship with surfaces 33 and 37 whereby to present a gradual change in the angular support for each bag.

Unlike the indexing table of applicant's earlier invention, in the improved configuration of the present invention the indexing table remains fixed in position and each bag is forceably transferred from the horizontal position atop drop plate 33 to the canted position on presenter plate 37 by an indexing table lever arm 32 having a suction cup assembly 62 attached to the end thereof. Arm 32 is attached at its other end to an underlying structure 39 in a manner to permit rotation of arm 32 through an arc of 45 degrees, the same angle as the angle between surface 33 and surface 37. A suction cup assembly 62 of arm 32 is controlled by a cylinder 43 to be selectively extended upwardly about two inches through a pair of slots 60 in the indexing table 30 so that the suction applied by means of suction cup assembly 62 in effect controls the position of each bag 1 between the time it is dropped on the horizontal surface 33 and the time it is picked up by picker-spouter apparatus 16. Arm 32 is controlled for angular motion by an actuator 45 having a rod 47 connected to arm 32. Actuator 45 is secured to support structure 26 whereby to rotate arm 32 with movement of rod 47.

Figure 5:
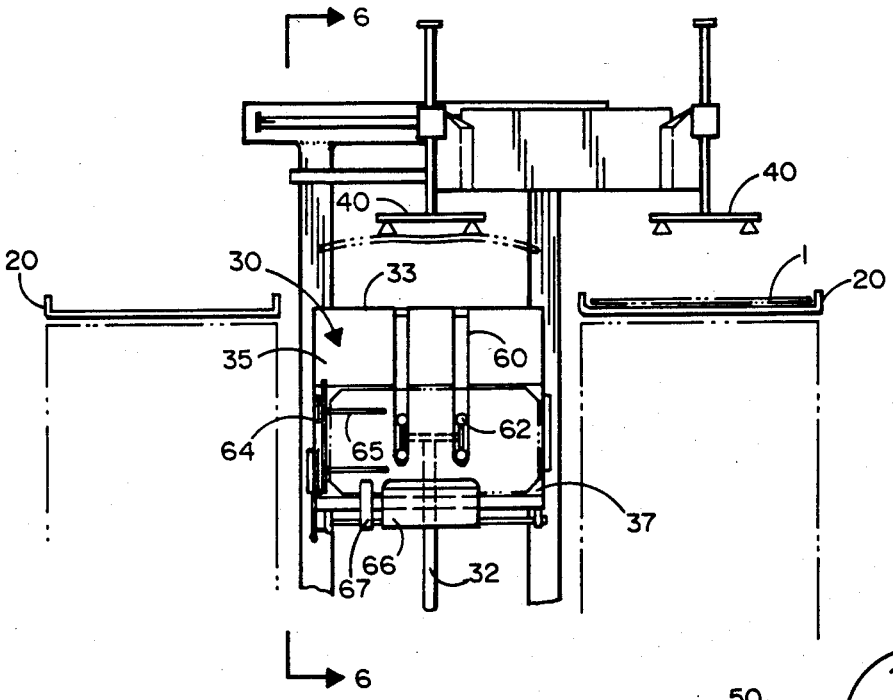

When each bag is dropped onto the drop plate 33, lever arm 32 is placed in its vertical configuration whereby suction cup assembly 62 secures the bag thereto. Indexing table lever arm 32 is then rotated clockwise as seen in FIG. 6 until the bag resides substantially on the presenter plate 37. When the vacuum is released, the bag is allowed to drop or slide the remaining approximately two inches along the surface 37 until its lower-most edge contacts an alignment bracket 66 which assures that the lower-most edge of each bag 1 is properly aligned relative to the picker-spouter apparatus 16 for proper placement of the bag. Surface 37 of indexing plate 30 is provided with a solenoid valve actuated fence 64 which slides along a pair of slots 65 from left to right as seen in FIGS. 4, 5 and 6 so that a second edge of each bag, perpendicular to the lower-most edge of the bag, is also properly registered relative to the picker-spouter apparatus. An elongated unfolding guide 67, adjacent bracket 66 is positioned as close to the valve bag top as possible to assist in unfolding the bag's top portion as it is withdrawn from surface 37 by the picker-spouter apparatus.

Those having skill in the art to which the present invention pertains may consider it an obvious expedient to increase the number of bags delivered from the magazine apparatus to the indexing table by simply doubling the number of magazine apparatus adjacent the presenter apparatus and by utilizing a synchronized pair of transfer mechanisms 44. However, it will now be recognized that the critical improvements to the presenter apparatus relating primarily to the indexing table 30 and tilt arm 32 are not obvious but rather radical design changes which render it possible to exploit the increased delivery rate of bags to the indexing table by significantly increasing the bag handling speed of the entire bag placer system of the present invention.

A significant additional improvement of the present invention as compared to applicant's previously disclosed invention is the substantially reduced linear motion of the picker-spouter apparatus 16 in its travel between the indexing table 30 and each spout 2. This motion is enabled by the design of the alignment bracket 66 and guide 67. More specifically, as seen in FIG. 6, alignment bracket 66 and unfolding guide 67 are connected to a bracket tilt mechanism 68 which is in turn connected to a tilt actuator 70 by an actuator arm 72. This interconnection permits rotation of alignment bracket 66 and unfolding guide 67 from the position indicated in FIG. 6 by solid lines to the position indicated by dotted lines whereby at least a significant portion of each bag may be, in effect, slid down along the tangential of the top of surface 37 during the travel of picker-spouter apparatus 16 as will be hereinafter more fully explained.

The bag may be advantageously imprinted with desired indicia as it passes between surfaces 33 and 37, by means of a contactless dot matrix spray printer 77 supported above surface 35 by a simple bracket 79.

Figure 8:
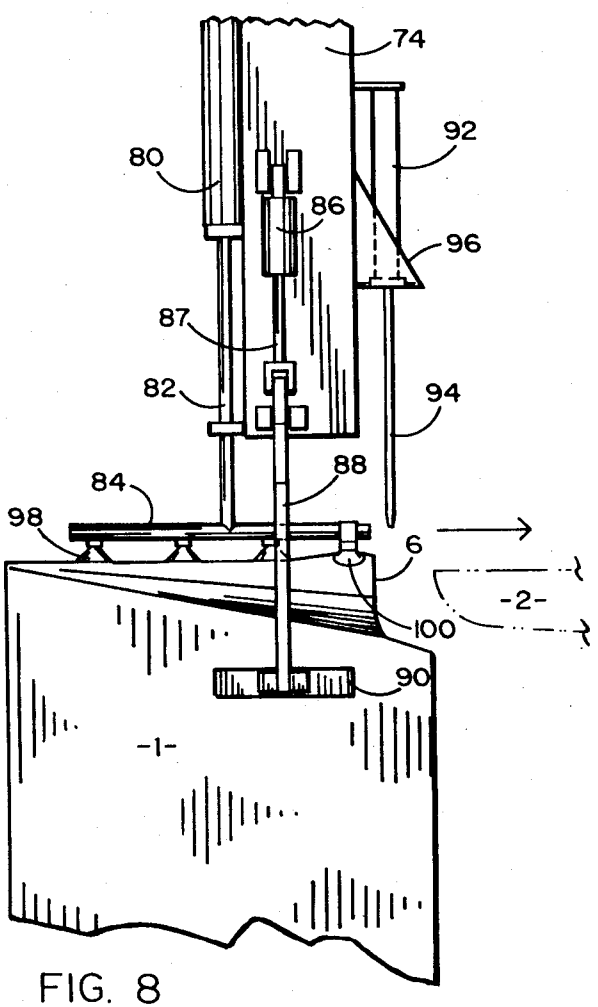
FIGS. 7 and 8 provide enlarged front and side views, respectively, of the picker-spouter apparatus of the present invention.
Figure 7:
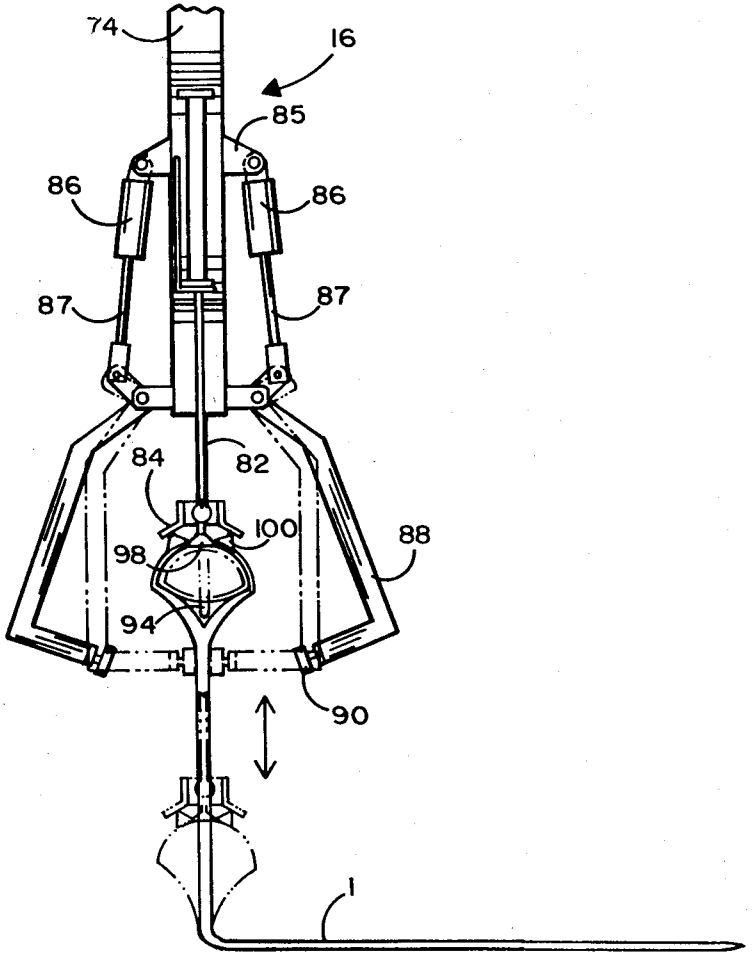

The picker-spouter apparatus 16 of the present invention may be better understood by referring to FIGS. 6, 7 and 8. More specifically, as seen in those figures, picker-spouter apparatus 16 comprises a picker-spouter arm 74 which is connected at a fulcrum point ot a rotator 73. Rotator 73 is, in turn, connected to a rotation arm 75 which is controlled by a pair of series coupled cylinders **76*a* and 76*b*. The mechanical coupling between arm 74 and rotator 73 has been omitted from FIG. 6 to enable a clear understanding of the swing operation of the picker-spouter apparatus 16. When rotator 73 is rotated fully clockwise as seen in FIG. 6, the rods of cylinders 76*a* and 76*b* are fully retracted and arm 74 is in its proper position for picking a bag from the presenter plate 37 as indicated in solid lines in FIG. 6. However, when the rods of cylinders 76*a* and 76*b* are fully extended, the rotator 73 is rotated to its fully counter-clockwise position and the arm 74 is in its substantially vertical position as shown by phantom lines in FIG. 6. In the vertical position of arm 74, the bag has been placed completely onto a spout 2**.

The swing transition of arm 74 over its angular travel of forty five degrees, is accomplished in a two-step process in order to assure reliable bag placement while still obtaining a high rate of bag handling. More specifically, as indicated in FIG. 6, the swing transition of arm 74 is performed in two angular motions of 30 degrees and 15 degrees, respectively. During the 30 degree swing transition, arm 74 also moves laterally along picker travel assembly 52 for alignment with a selected free spout 2 (see FIG. 1). Only when such alignment is achieved does arm 74 then complete its swing transition by accomplishing the remaining 15 degree motion thereby placing a bag on the selected spout.

The two step swing transition is provided by cylinders **76*a* and 76*b* whereby cylinder 76*b* is coupled to the rod of cylinder 76*a*. Only cylinder 76*a* is affixed to structure 50. Cylinder 76*b*, on the other hand, moves linearly upon activation of the rod of cylinder 76*a* and thus the linear travel due to activation of the rod of 76*b* is, in effect, added to the linear travel of the rod of cylinder 76*a*. Consequently, the sequential rod extension of cylinders 76*a* and 76*b*, acts through arm 75 and rotator 73 to sequentially swing picker arm 74** through two discrete sequential transitions.

The bag pick-up process is made possible by an actuator 80 having an actuator rod 82 the end of which is connected to a suction cup assembly 84 seen best in FIGS. 7 and 8. Actuator 80 is connected to arm 74. Also connected to arm 74 are a pair of brackets 85 to which are connected respective caliper actuators 86 each having an actuator rod 87 connected to one of two calipers 88 forming a clamp mechanism, the ends of which comprise grippers 90 for securely gripping each valve bag while the valve end thereof is attached to suction cup assembly 84.

As seen best in FIG. 8, the picker-spouter apparatus 16 also includes a push-rod actuator 92 having an extendible push-rod 94 for facilitating opening of the valve 6 of bag 1 to properly receive each filling spout 2. The actuator is secured to picker-spouter arm 74 by means of a bracket 96.

Another of the improvements in picker-spouter apparatus 16 as compared to applicant's previously disclosed apparatus in U.S. Pat. No. 4,334,558, resides in the distribution of suction cups of the suction cup assembly 84. More specifically, as seen best in FIGS. 7 and 8, suction cup assembly 84 comprises a plurality of suction cups 98 which are distributed longitudinally along the center of the assembly 84 to contact the valve portion 6 of the valve bag 1 along substantially the center of the valve flap. However, additional suction cups 100 are distributed laterally from the alignment of suction cups 98 whereby to secure the bag valve flap 6 at points displaced from the center thereof in order to more reliably assure an appropriate valve bag opening for receiving the spout 2. In addition, it will be observed principally in FIG. 8 that the grippers 90 have been substantially lengthened as compared to the corresponding apparatus of applicant's prior invention whereby to provide appropriate tension of each bag between the grippers 90 and suction cups 98 and 100 to further ensure proper opening of the valve of each bag for placement on a filling spout.

FIG. 7 illustrates the folded configuration of each bag even after the picker arm has fully withdrawn the bag valve from the presenter plate.

Perhaps the most important improvement in the operation of picker-spouter apparatus 16 resides in the substantially reduced linear motion of the arm 74 in removing each bag from the presenter plate 37. More specifically, because of the aforementioned redesign of the presenter plate with respect to alignment bracket 66 and unfolding guide 67, arm 74 lifts the valve portion of each bag about one foot from surface 37 before commencing its swing transition. In the applicant's prior invention it was necessary to first lift each bag almost entirely off of the previously employed tilt plate before beginning swing action. This improvement is particularly beneficial from the standpoint of increasing the bag handling rate in the present invention.

Those having skill in the art to which the present invention pertains will now understand that the applicant herein has disclosed a unique combination of apparatus to provide an automatic valve bag placer system that eliminates or substantially reduces the disadvantages of the prior art while at the same time providing means for an extremely high rate of bag placement thereby permitting placement on as many as three filling spouts by means of the present invention. A significant number of additional improvements as compared to applicant's prior disclosed invention described in detail in U.S. Pat. No. 4,334,558 have been disclosed. Thus for example, in the present invention two magazine apparatus are utilized to at least double the rate at which bags are delivered to an indexing table. In addition, the indexing table has been improved by providing means for forceably moving a bag into proper position by a picker-spouter apparatus without requiring time consuming tilting and gravity derived indexing as disclosed in said prior patent. Another significant improvement in the present invention resides in the picker-spouter apparatus made possible by a change in the configuration of the indexing table of the present invention. More specifically, the picker-spouter apparatus now picks up and moves the bag in a substantially circular path with a significantly reduced linear path thereby significantly reducing the time previously required to place the bag on the spout of a filler apparatus. Additionally, the filler spouter apparatus is provided with the new capability of moving transversely along a travel rod whereby to permit placement of bags alternatively on up to three spouts whereby to exploit the significantly increased rate of bag placing afforded by the improvements of the present invention.

Although a preferred embodiment of the best mode of the invention has been disclosed in sufficient detail to enable one skilled in the art to make and use the invention, it will now be understood that various modifications may be made to the specific configurations and components disclosed herein but that all such changes are contemplated to be within the scope of the invention which is to be limited only by the appended claims.

I claim:

1. An improved bag placer apparatus for placing a bag or the like having a valve at an end thereof upon a filler spout through which the bag is to be filled with a flowable material, the apparatus of the type having means for withdrawing one such bag at a time from a plurality of such bags and having means for gripping the end of the withdrawn bag having a valve for opening the valve prior to placement thereof on the filler spout; the improvement a bag registration apparatus for receiving each said one bag in a substantially horizontal position from said withdrawing means and for presenting each said one bag to said gripping means, and having means for automatically registering each said one bag for location of said valve end in precise position and alignment relative to said gripping means;

wherein said means for automatically registering comprises:

means for forceably aligning a first edge of said bag in a first dimension;

means for forceably aligning a second edge of said bag in a second dimension, said first and second edges of said bag being perpendicular to one another and lying in the plane of said bag;

a plurality of integrated surfaces having at least a first surface adapted to receive said bag in a substantially horizontal position and at least a second surface extending from said first surface and adapted to present said bag in a substantially perpendicular plane relative to said gripping means, said first and second surfaces being fixed relative to one another at an acute angle and having a smooth transition surface therebetween; and means for moving said bag from said first surface to said second surface.

2. The improved apparatus recited in claim 1 wherein said first and second surfaces are slotted by at least one continuous slot entirely through said surfaces, said slot extending longitudinally in a direction substantially parallel to the direction of motion of each bag from said first surface to said second surface, said means for moving comprising a suction cup assembly having an extendible rod actuator and a plurality of suction cups, said rod actuator being connected at one end to a fulcrum point for rotation relative thereto, said rod actuator having a rod extendible therefrom, said rod being connected to said suction cups, said suction cups being located within said slots whereby each bag on said first surface may be selectively repositioned from said first surface to said second surface by said suction cups.

3. The improved bag placer apparatus recited in claim 1 further comprises:

a picker-spouter having extendible suction means for securing and pulling an openable portion on a first side of the orifice of said valve;

a clamp mechanism for grasping said bag, below said valve orifice; and means for swinging said bag through an angular transition while simultaneously repositioning said bag in a direction substantially perpendicular to said angular transition whereby to align said bag with a selected spout and selectively place the valve orifice of said bag onto said selected spout.

4. The improved apparatus recited in claim 3 wherein said means for swinging said bag comprises means for dividing said angular transition into at least two discrete angular transition segments, a first such segment occurring simultaneously with said repositioning of said bag and a second such segment occurring after said repositioning is completed and said bag is aligned with a selected spout.

5. The improved apparatus recited in claim 4 wherein said first segment is about 30 degrees and said second segment is about 15 degrees.

6. The improved bag placer apparatus recited in claim 1 further comprises:

a pair of magazine apparatus, each such magazine apparatus positioned on an opposite side of said bag registration apparatus and each having a plurality of tiered shelves for supporting a plurality of vertical stacks of such bags, each such stack comprising a plurality of said bags in horizontal position, each such magazine apparatus also having means for sensing when the last bag of a stack has been withdrawn, and having means responsive to said sensing means for positioning another such stack into juxtaposition with said withdrawing means; and wherein said gripping means comprises, in combination, suction means for extending an openable portion on a first side of the orifice of said valve, a push rod for restraining a second side of the orifice of said valve, and a clamp mechanism for grasping said bag below said valve orifice, whereby said valve orifice is fully opened and said bag is securely gripped for being placed on a filling spout, said withdrawing means being adapted for delivering to said bag registration apparatus bags withdrawn alternately from each said magazine apparatus.

7. The improved apparatus recited in claim 6 wherein said gripping means further comprises means for swinging said bag through an angular transition while simultaneously repositioning said bag in a direction substantially perpendicular to said angular transition whereby to selectively place said valve orifice of said bag on to a selected filling spout.

8. The improved apparatus recited in claim 7 wherein said means for swinging said bag comprises means for dividing said angular transition into at least two segments, a first such segment occurring simultaneously with said repositioning of said bag and a second such segment occurring after said repositioning is completed and said bag is aligned with a selected spout.

* * * * *